United States Patent [19]

Kelley

[11] Patent Number: 4,882,533

[45] Date of Patent: Nov. 21, 1989

[54] LINEAR INTEGRATED CIRCUIT VOLTAGE DROP GENERATOR HAVING A BASE-10-EMITTER VOLTAGE INDEPENDENT CURRENT SOURCE THEREIN

[75] Inventor: Mark Kelley, Nashua, N.H.

[73] Assignee: Unitrode Corporation, Lexington, Mass.

[21] Appl. No.: 312,373

[22] Filed: Feb. 15, 1989

Related U.S. Application Data

[63] Continuation of Ser. No. 90,336, Aug. 28, 1987, abandoned.

[51] Int. Cl.[4] ..... G05F 3/16

[52] U.S. Cl. ..... 323/313; 323/315; 323/907; 307/310; 307/296.6

[58] Field of Search ..... 323/313, 314, 907; 307/296 R, 297, 310

[56] References Cited

U.S. PATENT DOCUMENTS 4,091,321 5/1978 Hanna ..... 323/314

4,590,419 5/1986 Moriarty, Jr. ..... 323/313

4,605,892 8/1986 Seevinck et al. ..... 323/315

OTHER PUBLICATIONS

Gray, P. R.; Meyer, R. G., Analysis and Design of Analog Integrated Circuits, University of California, Berkely, John Wiley & Sons Publishers, pp. 207–208.

*Primary Examiner*—Patrick R. Salce
*Assistant Examiner*—Anita M. Ault
*Attorney, Agent, or Firm*—Weingarten, Schurgin, Gagnebin & Hayes

[57] ABSTRACT

A voltage drop generator having a current source having reduced sensitivity to transistor base-emitter voltage process and temperature induced variations, is used to generate a precise voltage drop across a resistor. Transistor emitter area ratios are selected and an additional resistance is used in conjunction with the selected ratios to reduce the sensitivity (of the output voltage drop) to base-emitter voltages, to provide substantial improvement in process and temperature dependent output variations.

13 Claims, 2 Drawing Sheets

LINEAR INTEGRATED CIRCUIT VOLTAGE DROP GENERATOR HAVING A BASE-10-EMITTER VOLTAGE INDEPENDENT CURRENT SOURCE THEREIN

This application is a continuation of application Ser. No. 090,336, filed Aug. 28, 1987, abandoned.

FIELD OF THE INVENTION

The present invention relates to circuits providing a selected voltage drop across a resistance, and in particular voltage drop circuits including a current source wherein the output current produced has reduced sensitivity to transistor base-emitter voltage process and temperature variations.

BACKGROUND OF THE INVENTION

Previous circuits used to provide selected voltage drops across a load resistance typically included current source circuitry having the Wilson topology which provides an output current controlled by voltage at an input terminal, as generally determined by the selection of resistor components in the topology. However, prior art the topology, such as shown in FIGS. 1 and 2 exhibits significant transistor base-emitter voltage process and temperature variation dependencies. Therefore, the applicability of the Wilson-type current source is limited to those applications wherein the process and temperature induced variations can be tolerated.

SUMMARY OF THE INVENTION

The present invention provides a constant voltage drop across a selected resistance, having enhanced performance over a wide variety of temperatures and production process variations. The present invention includes a novel constant current source having reduced sensitivity to temperature and process variation, provides the constant voltage drop when used with a selected load resistance. The present invention selects the emitter area ratios of the transistors incorporated in the constant current source circuit topology, and provides an additional base resistor to provide operation independent of temperature and process variations. The resulting product provides substantially no sensitivity to variation in $V_{BE}$ through production, and over a temperature range of at least −55° to +125° C. Moreover, the constant current source may be used in other applications apart from the constant voltage drop application of the preferred embodiment below.

BRIEF DESCRIPTION OF THE DRAWINGS

These and other features according to the present invention will be better understood by reading the following detailed description, taken together with the drawing wherein.

DETAILED DESCRIPTION OF THE INVENTION

Figure 4:
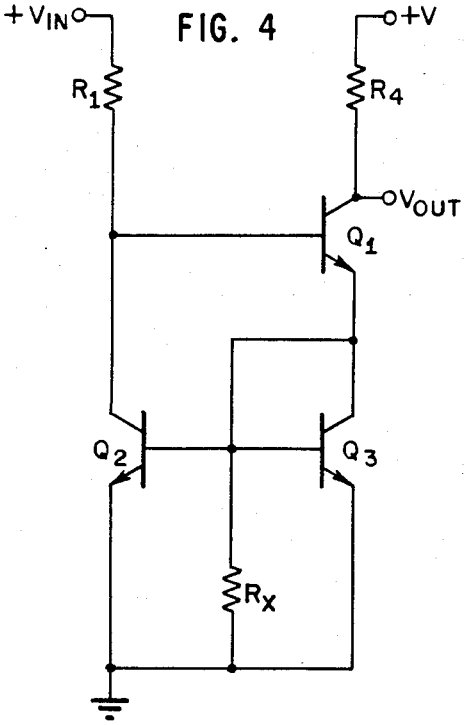
FIG. 4 is a second embodiment of the present invention without emitter degeneration resistors.
Figure 3:
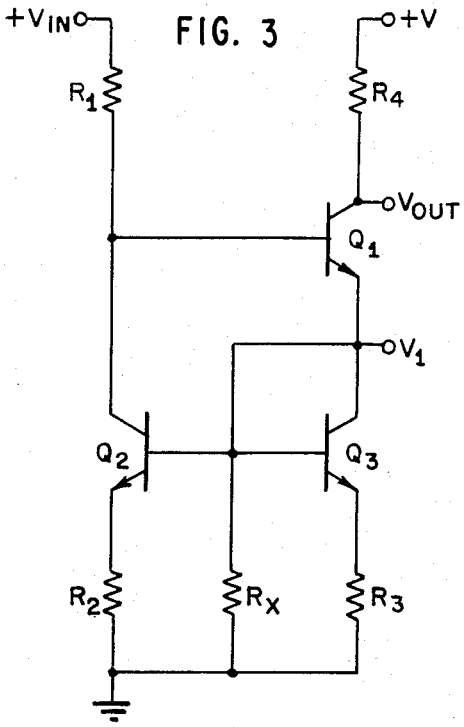
FIG. 3 is a first embodiment of the present invention.

The circuit topologies of the present invention are shown in FIG. 3, and in FIG. 4 excluding emitter degeneration resistors $R_2$ and $R_3$.

The embodiment shown at FIG. 3 provides the improved current source of the present invention, wherein the resistances (R) and transistor emitter area (A) ratios for the lowest temperature coefficient and higher Beta independence are determined by the following formulas $$\text{Let } R_1+R_2=R\text{ total}=R_T \tag{1}$$

Let n=number of base-emitter junctions directly in series with $R_1$ in such a way that their current is equal to the current in $R_1$.

IN FIG. 3

$$n = 2. \tag{2}$$

$$R_T = \frac{V_{IN} - V_{BE}(n+2)}{I_{IN}} \tag{3}$$

$$R_x = \frac{V_{IN}}{(n+2)I_{IN}} \tag{4}$$

$$\frac{A_2}{A_3} \geqq 1 + \frac{V_{BE}(n+2)}{V_{IN} - V_{BE}(n+2)} \tag{5}$$

Preferably a transistor ratio which is $$> 1 + \frac{V_{BE}(n+2)}{V_{IN} - V_{BE}(n+2)} \tag{6}$$

because it is at this ratio where $R_2$ and $R_3$ subsequently (and rapidly) go to 0 ohms.

$$R_3 = \frac{R_T - A_2}{A_3} \tag{7}$$

$$R_2 = \frac{R_3 A_3}{A_2} \tag{8}$$

$$R_1 = R_T - R_2 \tag{9}$$

$$A_1 = A_2 \tag{10}$$

If there are other emitter-base junctions directly in series with $R_1$ in such a way that their currents are equal to the current in $R_1$, then their area also equals $A_2$.

Choosing a ratio which is easily achieved in production, such as 2:1, works very well. However in the case of FIG. 4 which has neither $R_2$ nor $R_3$, $$\frac{A_2}{A_3} = 1 + \frac{V_{BE}(n+2)}{V_{IN} - V_{BE}(n+2)} \tag{11}$$

According to the present invention, the value chosen for $V_{BE}$ in the above equations needs only to be a best estimate, since the present invention is relatively insensitive to changes in the $V_{BE}$. Since many applications do not require an exact input current calculation, but only that the current at the output be constant and precise, the value chosen for $V_{BE}$ is mainly necessary to determine the current in resistors $R_1$ and $R_2$, and to determine if there is enough input and output voltage headroom for proper operation of the current source according to the present invention.

The improvement of the current source according to the present invention is directly related to the Beta of the transistors $Q_1$, and $Q_2$ and the ratio $$\frac{\Delta V_{BE1}}{\Delta V_{BE2}} \tag{12}$$

Depicted in the following equation (13) is the ability of FIG. 3 to reject (at its output) those changes in input current which stem from changes in $V_{BE}$ $$\frac{dI_{IN}}{dI_{OUT}} \simeq \frac{1 + 1/\beta\,(1/(\beta + 1) + A_3/A_2 + R_2/R_x)}{\dfrac{\alpha(R_1 + R_2)}{-R_x\left(1 + \dfrac{dV_{BE1}}{dV_{BE2}}\right)} + 1/(\beta + 1) + A_3/A_2 + R_2/R_x} \tag{13}$$

where $^{dV}BE_1$ and $^{dV}BE_2$ are the change in $V_{BE}$ of $Q_1$ and $Q_2$, respectively, and where $dI_{IN}$ is defined as $$dI_{IN} = -\frac{dV_{BE1} + dV_{BE2}}{R_1 + R_2} \tag{14}$$

This yields, for example, a rejection ratio of 43 at a (typical) Beta of 100. This reflects a significant improvement over the (prior art) Wilson, where $$\frac{dI_{IN}}{dI_{OUT}} \simeq 1 \tag{15}$$

As demonstrated by the above equation, it is important to realize that, although the change in input current ($dI_{IN}$) is dependent upon the sum of $$^{dV}BE_1 + {}^{dV}BE_2 \tag{16}$$

the change in output current is dependent upon the ratio of $$\left(\frac{dV_{BE1}}{dV_{BE2}}\right) \tag{17}$$

Furthermore, that although the rejection ratio $$\frac{dI_{IN}}{dI_{OUT}} \tag{18}$$

decreases as Beta decreases, $$\frac{dV_{BE1}}{dV_{BE2}} \tag{19}$$

decreases as temperature decreases. This works to strongly oppose a drop in rejection ratio as temperatures drop.

Figure 1:
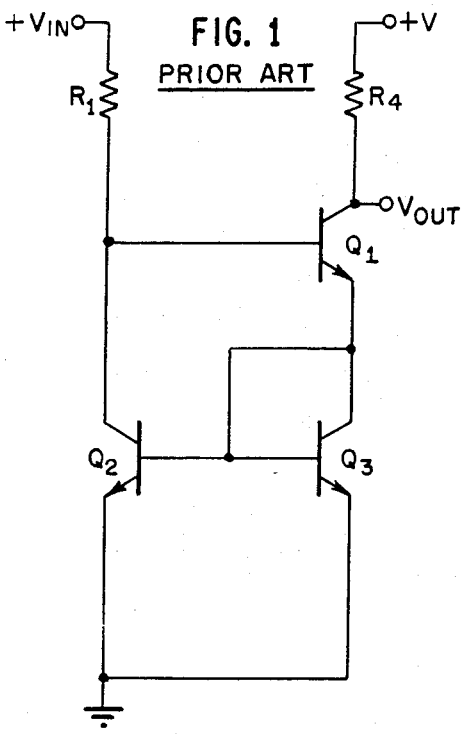
FIG. 1 PRIOR ART
FIG. 1 is a prior art Wilson current source being used to generate a voltage drop across a load resistor, $R_4$.
Figure 2:
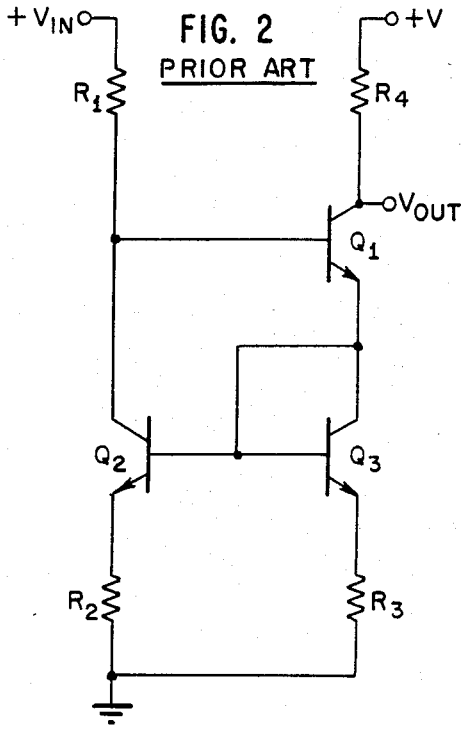
FIG. 2 PRIOR ART
FIG. 2 is a prior art Wilson current source having emitter resistors being used to generate a voltage drop across a load resistor, $R_4$.
Figure 5:
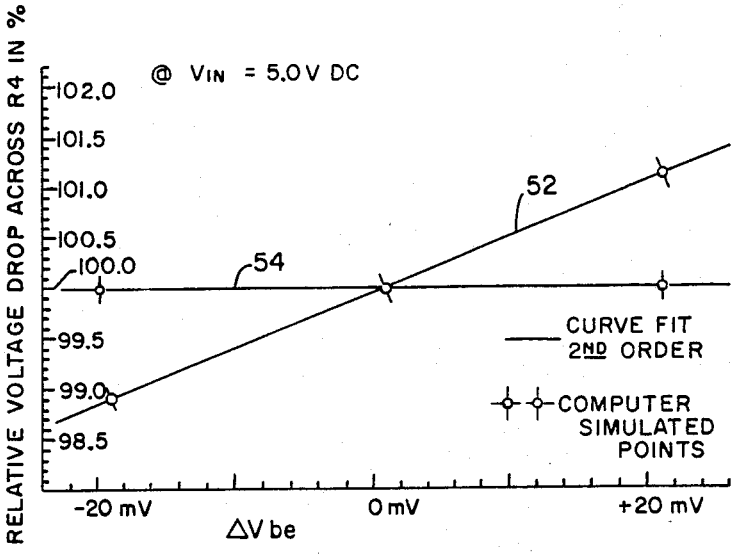
FIG. 5 is a graph showing the variation in voltage drop across the load resistor, $R_4$ over a change in $V_{BE}$ for FIG. 3 at $V_{IN}$=5 V D.C.
Figure 6:
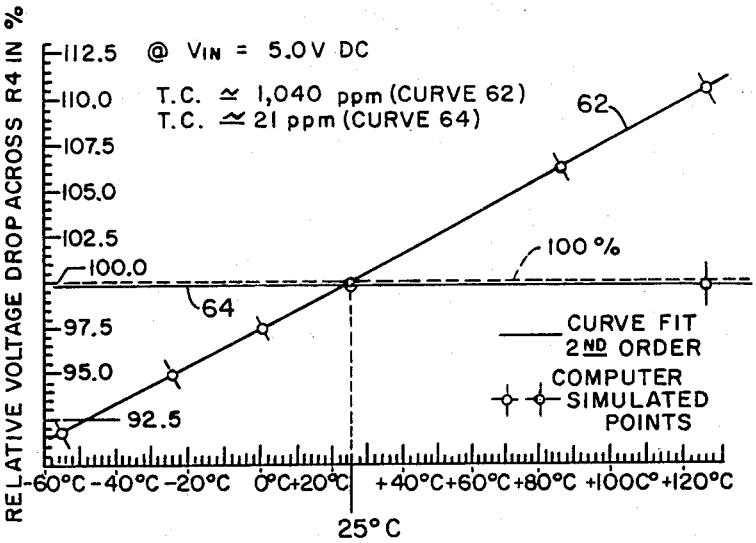
FIG. 6 is a graph showing the variation in voltage drop across the load resistor, $R_4$ according to variations in operating temperature for FIG. 3 at $V_{IN}$=5 V D.C.

The stability of the output is shown in FIGS. 5 and 6. The graph of FIG. 5 shows the change in voltage drop across $R_4$ for a change in $V_{BE}$, a process dependent variable. The stability of the prior art Wilson circuits of FIGS. 1 and 2 is illustrated in curve 52. The present invention according to the circuit of FIG. 3 is illustrated by curve 54.

Thermal sensitivities are illustrated by FIG. 6, wherein the prior art of FIGS. 1 and 2 is shown by curve 62. The improved thermal stability of the present invention according to the circuit of FIG. 3 is illustrated by curve 64.

Substitutions and modifications of the circuitry according to the present invention made within the level of one skilled in the art is considered to be within the scope of the present invention, which is not limited except by the claims which follow.

What is claimed is:

1. A voltage drop generator comprising a first, second and third transistor each having an emitter, a base and a collector;

a first resistor having one end connected to a common connection and the other end connected to the emitter of the first transistor, the base of said second transistor, the base of the third transistor, and the collector of said third transistor;

a second resistor having one end connected to both the collector of said second transistor and to the base of the first transistor and the other end connected to a control signal relative to said common connection;

a third resistor having one end connected to a supply potential and the other end connected to the collector of the first transistor developing a voltage drop thereacross in response to a control voltage, wherein, the emitter of said second and said third transistor is connected to said common connection providing a return for said supply potential connected to said third resistor, and said voltage drop generator provides reduced sensitivity to variations of $V_{BE}$ and temperature of said first, second and third transistors.

2. The voltage drop generator of claim 1, further including a fourth and a fifth resistor each connected in series with the emitter of said second and third transistors, respectively.

3. The voltage drop generator of claim 2, wherein the emitter areas between said second and third transistors are determined according to the formula $$\frac{A_2}{A_3} > 1 + \frac{V_{BE}(n + 2)}{V_{IN} - V_{BE}(n + 2)}$$

4. The volage drop generator of claim 1, wherein the emitter areas of said second and third transistors are determined by a ratio $$\frac{A_2}{A_3} = 1 + \frac{V_{BE}(n + 2)}{V_{IN} - V_{BE}(n + 2)}$$

5. The voltage drop generator of claim 1, wherein the emitter areas of said first and second transistors are equal.

6. The voltage drop generator of claim 1, wherein said first resistor is chosen according to the value of the control voltage divided by the product of the number of base-emitter junctions in series with said second resistor and the value of the current resulting from said control signal through said second resistor.

7. A current source comprising a first, second and third transistor each having an emitter, a base and a collector;

a first resistor having one end connected to a common connection and the other end connected to the emitter of the first transistor, the base of said second transistor, the base of the third transistor, and the collector of said third transistor;

a second resistor having one end connected to both the collector of said second transistor and to the base of the first transistor and the other end connected to a control signal relative to said common connection, wherein a flow of current through the collector of the first transistor is provided in response to a control voltage, the emitter of said second and said third transistor is connected to said common connection providing a return for said flow of current through the collector of said first transistor, and wherein said current source output has reduced sensitivity to variations of $V_{BE}$ and temperature of said first, second and third transistors.

8. The current source of claim 7, further including a fourth and a fifth resistor each connected in series with the emitter of said second and third transistors, respectively.

9. The current source of claim 8, wherein the emitter areas between said second and third transistors are determined according to the formula $$\frac{A_2}{A_3} > 1 + \frac{V_{BE}(n+2)}{V_{IN} - V_{BE}(n+2)}$$

10. The current source of claim 7, wherein the emitter areas of said second and third transistors are determined by a ratio $$\frac{A_2}{A_3} = 1 + \frac{V_{BE}(n+2)}{V_{IN} - V_{BE}(n+2)}$$

11. The current source of claim 10, wherein the emitter areas of said first and second transistors are equal.

12. The current source of claim 7 further including a third resistor connected to a supply and to the collector of said first transistor.

13. The current source of claim 7, wherein said first resistor is chosen according to the value of the control voltage divided by the product of the number of base-emitter junctions in series with said second resistor and the value of the current resulting from said control signal through said second resistor.

* * * * *

UNITED STATES PATENT AND TRADEMARK OFFICE

CERTIFICATE OF CORRECTION

PATENT NO. : 4,882,533

DATED : November 21, 1989

INVENTOR(S) : Mark Kelley

It is certified that error appears in the above-identified patent and that said Letters Patent is hereby corrected as shown below:

ON TITLE PAGE:

[54] In line 3, "BASE-10-EMITTER" should read --BASE-TO-EMITTER--.

In Column 1, line 3, "BASE-10-EMITTER" should read --BASE-TO-EMITTER--.

Signed and Sealed this

Twenty-eighth Day of April, 1992

*Attest:*

HARRY F. MANBECK, JR.

*Attesting Officer*

*Commissioner of Patents and Trademarks*